US011857098B2

(12) United States Patent
Berman et al.

(10) Patent No.: US 11,857,098 B2
(45) Date of Patent: Jan. 2, 2024

(54) CURVED CURTAIN ROD

(71) Applicant: House of Atlas, LLC, Evanston, IL (US)

(72) Inventors: Matthew Berman, Chicago, IL (US); Alan Arthur Ford, Sturgis, MI (US); Jason Moss, Libertyville, IL (US)

(73) Assignee: House of Atlas, LLC, Evanston, IL (US)

( * ) Notice: Subject to any disclaimer, the term of this patent is extended or adjusted under 35 U.S.C. 154(b) by 365 days.

(21) Appl. No.: 17/333,752

(22) Filed: May 28, 2021

(65) Prior Publication Data

US 2021/0378433 A1 Dec. 9, 2021

Related U.S. Application Data

(60) Provisional application No. 63/034,662, filed on Jun. 4, 2020.

(51) Int. Cl.

| | |
|---|---|
| ***A47H 1/022*** | (2006.01) |
| ***A47H 1/122*** | (2006.01) |
| *A47H 1/02* | (2006.01) |

(52) U.S. Cl.

CPC ..... *A47H 1/022* (2013.01); *A47H 1/122* (2013.01); *A47H 2001/0205* (2013.01)

(58) Field of Classification Search

CPC . A47H 1/02; A47H 1/022; A47H 1/03; A47H 1/04; A47H 1/08; A47H 1/10; A47H 1/102; A47H 1/104; A47H 1/12; A47H 1/122; A47H 1/124; A47H 1/13; A47H 1/14; A47H 1/142; A47H 1/144; A47H 2001/0205; A47H 2001/021; A47H 2001/0215; A47H 2001/042; A47H 2001/045; A47H 2001/047; A47K 3/38

USPC ..... 211/105.3

See application file for complete search history.

(56) References Cited

U.S. PATENT DOCUMENTS

| | | | |
|---|---|---|---|
| 6,216,287 | B1 | 4/2001 | Wise |
| 6,694,543 | B2 | 2/2004 | Moore |
| D499,329 | S | 12/2004 | Suero, Jr. |
| D500,670 | S | 1/2005 | Rebman |
| D501,737 | S | 2/2005 | Clucas |
| D501,738 | S | 2/2005 | Clucas |
| D504,310 | S | 4/2005 | Harwanko |
| D504,807 | S | 5/2005 | Harwanko |
| D505,062 | S | 5/2005 | Suero, Jr. |
| D505,317 | S | 5/2005 | Harwanko |
| D507,129 | S | 7/2005 | Harwanko |
| D513,142 | S | 12/2005 | Suero, Jr. |
| D513,373 | S | 1/2006 | Harwanko |
| D516,902 | S | 3/2006 | Harwanko |
| D522,844 | S | 6/2006 | Harwanko |
| D522,845 | S | 6/2006 | Suero, Jr. |
| D522,846 | S | 6/2006 | Suero, Jr. |
| D522,847 | S | 6/2006 | Suero, Jr. |

(Continued)

FOREIGN PATENT DOCUMENTS

CA 2909854 A1 * 4/2016 ..... A47H 1/022

*Primary Examiner* — Joshua E Rodden

(74) *Attorney, Agent, or Firm* — Fitch Even Tabin & Flannery LLP

(57) ABSTRACT

A curved curtain rod is provided with adjustable rods and an adjustable end cap assembly. The adjustable end cap assembly includes a user accessible drive element that can be rotated to operate the adjustable end cap assembly.

12 Claims, 19 Drawing Sheets

(56) References Cited

U.S. PATENT DOCUMENTS

D525,115 S 7/2006 Harwanko
D526,520 S 8/2006 Clucas
D527,246 S 8/2006 Clucas
D534,793 S 1/2007 Suero, Jr.
D542,392 S 5/2007 Hanley
D542,897 S 5/2007 Harwanko
D543,747 S 6/2007 Harwanko
D543,748 S 6/2007 Harwanko
D545,180 S 6/2007 Harwanko
D548,574 S 8/2007 Harwanko
D551,010 S 9/2007 Woodhouse
D562,608 S 2/2008 Kramer
D562,609 S 2/2008 Kramer
D563,136 S 3/2008 Kramer
D563,138 S 3/2008 Kramer
D566,991 S 4/2008 Harwanko
D568,656 S 5/2008 Kramer
D569,149 S 5/2008 Walker
D569,668 S 5/2008 Kramer
D571,136 S 6/2008 Kramer
D573,386 S 7/2008 Clucas
D573,387 S 7/2008 Walker
D576,475 S 9/2008 Didehvar
D576,476 S 9/2008 Didehvar
D586,647 S 2/2009 Didehvar
D591,142 S 4/2009 Cittadino
D611,328 S 3/2010 Hanley
D628,000 S 11/2010 Lindo
D632,513 S 2/2011 Cittadino
D632,514 S 2/2011 Didehvar
D632,515 S 2/2011 Cittadino
D635,807 S 4/2011 Lindo
D640,488 S 6/2011 Didehvar
7,958,577 B2 * 6/2011 Chang ..... A47K 3/38 4/558
D641,190 S 7/2011 Cittadino
D641,191 S 7/2011 Walker
D641,193 S 7/2011 Vaccaro
D641,194 S 7/2011 Vaccaro
7,984,814 B2 7/2011 Didehvar
D643,236 S 8/2011 Cittadino
D643,657 S 8/2011 Cittadino
D644,050 S 8/2011 Cittadino
D648,969 S 11/2011 Cittadino
D649,352 S 11/2011 Cittadino
8,056,873 B1 11/2011 Hanely
8,069,507 B2 12/2011 Didehvar
8,069,999 B2 12/2011 Didehvar
D652,236 S 1/2012 Walker
D652,237 S 1/2012 Cittadino
D653,067 S 1/2012 Cittadino
8,113,361 B2 2/2012 Winter
8,146,182 B2 4/2012 Bauer
8,157,111 B2 4/2012 Didehvar
D660,064 S 5/2012 Webb
D660,065 S 5/2012 Webb
D660,066 S 5/2012 Webb
8,166,583 B1 5/2012 Liang
8,185,981 B2 5/2012 Didehvar
D661,529 S 6/2012 Cittadino
D661,927 S 6/2012 Cittadino
8,205,760 B2 * 6/2012 Chang ..... A47K 3/38 211/105.3
D664,423 S 7/2012 Cittadino
D664,424 S 7/2012 Cittadino
8,214,938 B2 7/2012 Hanley
8,215,501 B2 * 7/2012 Trettin ..... A47K 3/38 211/105.6
D666,012 S 8/2012 Walker
D667,246 S 9/2012 Cittadino
D667,295 S 9/2012 Harwanko
D670,521 S 11/2012 Cittadino
D670,522 S 11/2012 Cittadino
D670,944 S 11/2012 Cittadino
D671,347 S 11/2012 Cittadino
D671,348 S 11/2012 Cittadino
D671,395 S 11/2012 Harwanko
D672,178 S 12/2012 Walker
D672,990 S 12/2012 Lindo
D672,991 S 12/2012 Cittadino
8,341,775 B2 1/2013 Didehvar
D680,421 S 4/2013 Martin
D681,422 S 5/2013 Lindo
D681,423 S 5/2013 Walker
D684,037 S 6/2013 Harwanko
8,522,373 B2 9/2013 Bauer
8,528,753 B2 * 9/2013 Woolley, II ..... A47H 1/102 211/105.3
D691,029 S 10/2013 Didehvar
D691,030 S 10/2013 Lindo
D691,031 S 10/2013 Harwanko
D693,209 S 11/2013 Walker
8,573,416 B2 11/2013 Didehvar
D696,573 S 12/2013 Didehvar
D702,112 S 4/2014 Cittadino
8,763,822 B2 7/2014 Didehvar
8,800,072 B2 8/2014 Chang
8,814,114 B2 8/2014 Baines
8,827,587 B2 9/2014 Didehvar
8,839,980 B2 9/2014 Baines
D714,571 S 10/2014 Walker
8,851,305 B2 10/2014 Didehvar
8,851,435 B1 10/2014 Bastien
8,869,999 B2 10/2014 Lindo
8,875,770 B1 11/2014 Martin
8,960,456 B2 2/2015 Didehvar
8,978,228 B2 3/2015 Didehvar
8,991,625 B2 * 3/2015 Bucklew ..... A47H 1/022 211/105.3
9,009,878 B2 4/2015 Baines
D729,618 S 5/2015 Bastien
D730,162 S 5/2015 Bastien
9,033,163 B2 5/2015 Hsu
9,044,115 B1 * 6/2015 Chirigotis ..... A47K 3/38
9,066,637 B2 6/2015 Zeng
9,107,495 B2 8/2015 Lindo
9,107,496 B2 8/2015 Lindo
9,107,529 B2 8/2015 Didehvar
9,107,544 B2 8/2015 Cittadino
9,131,795 B2 9/2015 Didehvar
9,161,664 B2 10/2015 Zeng
9,204,764 B1 12/2015 Hanley
D746,667 S 1/2016 Vaccaro
9,271,592 B2 3/2016 Didehvar
9,388,837 B1 7/2016 Hanley
9,474,421 B2 10/2016 Baines
9,578,995 B2 2/2017 Hanley
9,770,138 B2 9/2017 Engell
D811,205 S 2/2018 Hanley
D813,021 S 3/2018 Hanley
D813,022 S 3/2018 Hanley
10,051,985 B2 8/2018 Jones
10,064,523 B2 9/2018 Engell
10,070,748 B2 9/2018 Hanley
10,092,126 B2 10/2018 Baines
10,098,508 B1 * 10/2018 Switzer ..... A47H 1/02
D834,925 S 12/2018 Hanley
D834,926 S 12/2018 Hanley
D834,927 S 12/2018 Hanley
D847,613 S 5/2019 Hanley
10,278,529 B2 5/2019 Baines
D856,785 S 8/2019 Hanley
D858,259 S 9/2019 Hanley
D858,260 S 9/2019 Hanley
D859,963 S 9/2019 Hanley
10,458,452 B2 * 10/2019 Beyda ..... F16B 7/1427
10,463,199 B2 11/2019 Coratolo
10,786,105 B2 * 9/2020 Scanlon ..... A47H 1/142
10,794,063 B1 * 10/2020 Martin ..... E04F 11/1859
2005/0268394 A1 * 12/2005 Monk ..... A47K 3/38 4/558
2008/0115265 A1 * 5/2008 Heaslip ..... A47K 3/38 4/610

(56) References Cited

U.S. PATENT DOCUMENTS

| | | | | |
|---|---|---|---|---|
| 2011/0000051 | A1* | 1/2011 | Liang | A47K 3/38 16/94 R |
| 2012/0110729 | A1* | 5/2012 | Baines | A47K 3/38 4/610 |
| 2013/0269099 | A1* | 10/2013 | Chang | A47K 3/38 4/610 |
| 2013/0292349 | A1* | 11/2013 | Bucklew | A47H 1/022 248/265 |
| 2014/0130331 | A1* | 5/2014 | Didehvar | A47K 3/38 29/434 |
| 2014/0131299 | A1* | 5/2014 | Didehvar | A47H 1/142 29/525.01 |
| 2015/0034581 | A1* | 2/2015 | Hsu | A47H 1/142 211/105.3 |
| 2015/0265086 | A1 | 9/2015 | Hanley | |
| 2016/0374518 | A1 | 12/2016 | Baines | |
| 2018/0008101 | A1 | 1/2018 | Engell | |
| 2018/0064279 | A1 | 3/2018 | Hanley | |
| 2018/0296018 | A1 | 10/2018 | Baines | |
| 2018/0306219 | A1 | 10/2018 | Hanley | |
| 2019/0099034 | A1 | 4/2019 | Hanley | |
| 2019/0200795 | A1* | 7/2019 | Liang | A47H 1/142 |
| 2019/0249701 | A1* | 8/2019 | Beyda | A47H 1/022 |
| 2019/0282017 | A1 | 9/2019 | Hanley | |
| 2019/0298091 | A1* | 10/2019 | Wright | A47B 61/003 |
| 2021/0378433 | A1* | 12/2021 | Berman | A47H 1/022 |

* cited by examiner

CURVED CURTAIN ROD

CROSS-REFERENCE TO RELATED APPLICATION

This application claims the benefit of U.S. Provisional Application No. 63/034,662, filed Jun. 4, 2020, which is hereby incorporated herein by reference in its entirety.

FIELD

The subject matter of this application pertains to support rods and, more particularly, to curved support rods.

BACKGROUND

Curtain rods are used to suspend curtains for windows and/or bathtub enclosures. Curtain rods that curve outward from the enclosures have been used to increase the space in the enclosure. There is a need for an improved curved curtain rod assembly that is aesthetically pleasing, provides better sealing at a wall, and supports more weight.

DETAILED DESCRIPTION

Figure 1:
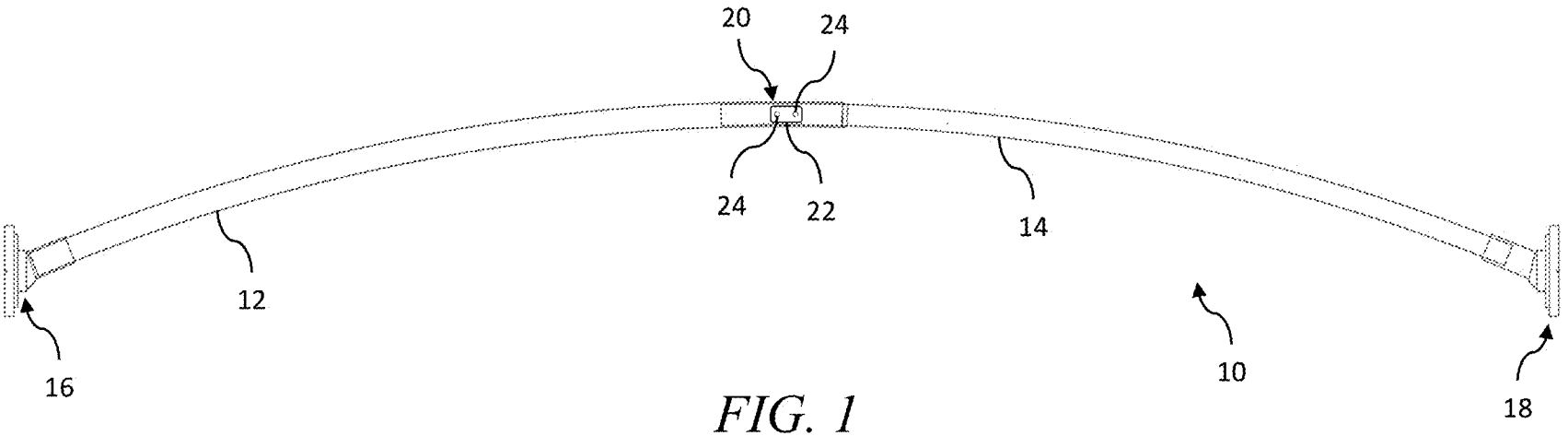
FIG. 1 is an elevational view of a curved curtain rod in an extended state.
Figure 2:
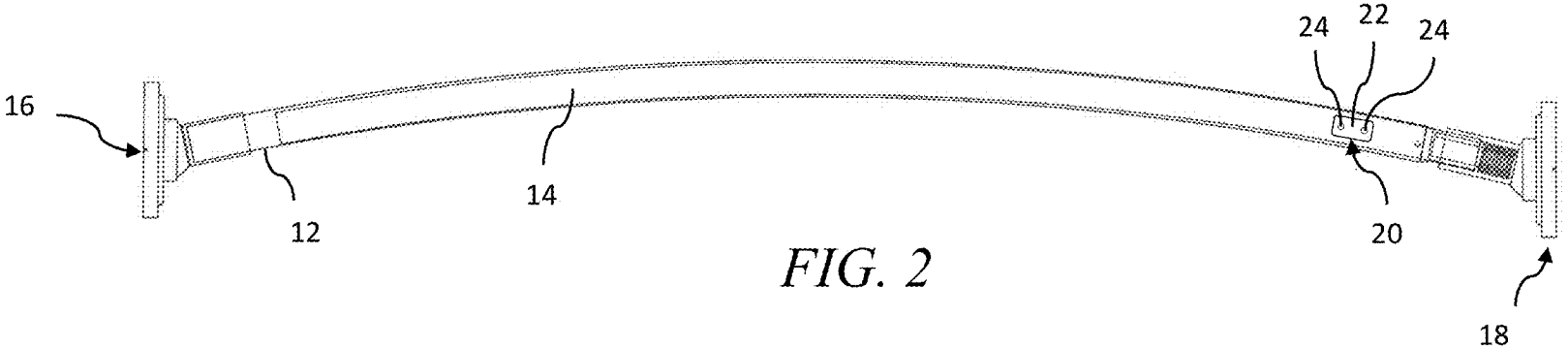
FIG. 2 is an elevational view of the curved curtain rod of FIG. 1 in a retracted state.
Figure 3A:
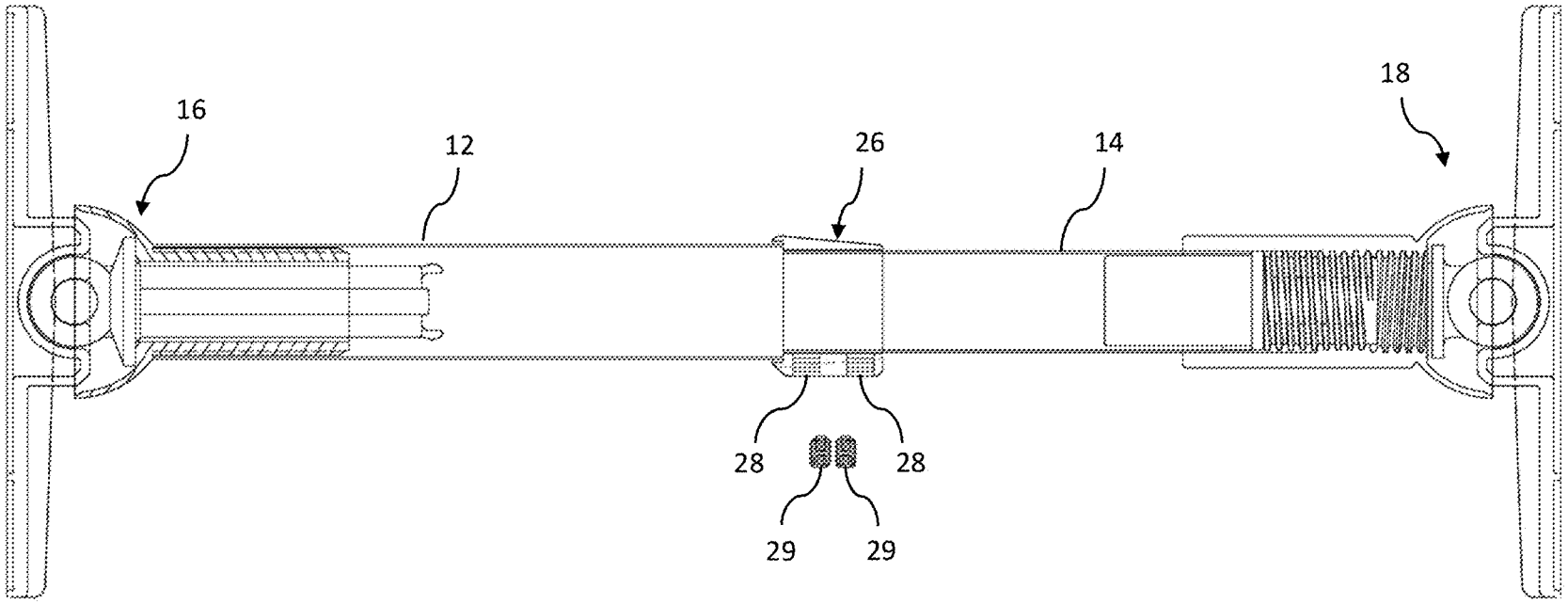
FIG. 3A is a cross-section view of the curved curtain rod of FIG. 1 using a collar rod connector.
Figure 3C:
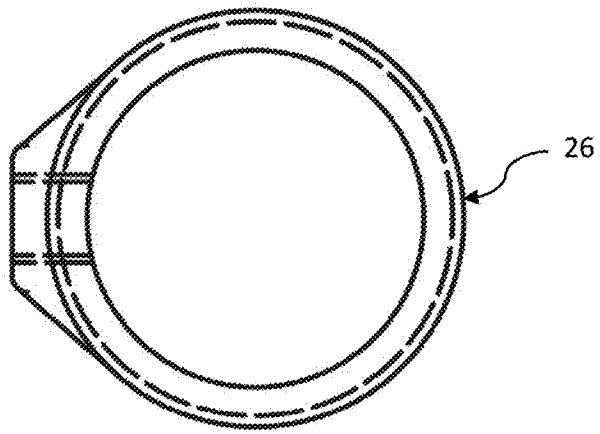
FIG. 3C is a bottom plan view of the collar connector of FIG. 3B.
Figure 3E:
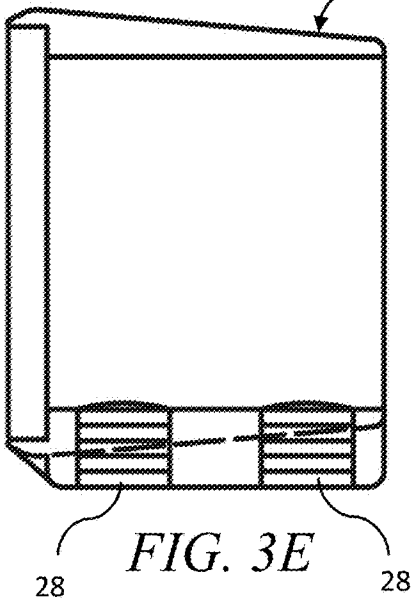
FIG. 3E is a cross-section view of the collar connector of FIG. 3B taken along line 3E-3E of FIG. 3D.
Figure 3B:
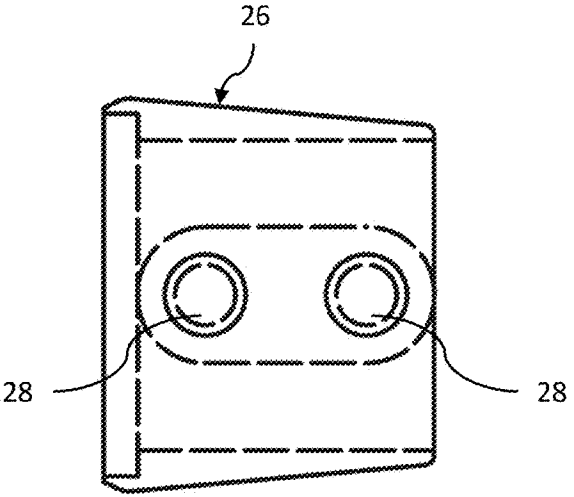
FIG. 3B is an elevational view of the collar connector of FIG. 3A.
Figure 3D:
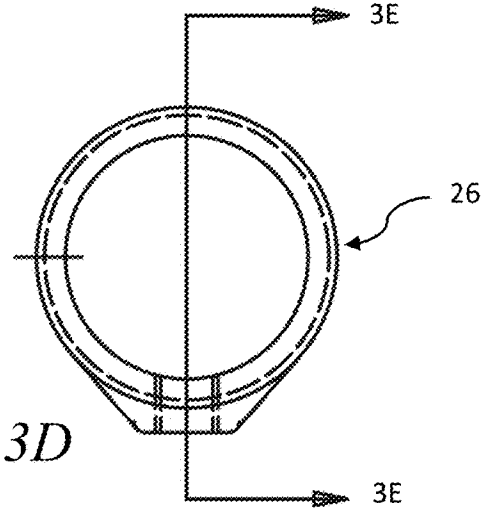
FIG. 3D is a top plan view of the collar connector of FIG. 3B.

Referring to FIGS. 1 and 2, there is illustrated a curved curtain rod 10 shown in an extended state (FIG. 1) and a retracted state (FIG. 2). The curved curtain rod 10 includes an outer curved rod 12 and an inner curved rod 14 that telescopes in and out of the outer rod 12 to adjust the combined length of the rods 12, 14. A fixed end cap assembly 16 is attached to one end of the outer curved rod 12, and an adjustable end cap assembly 18 is attached to one end of the inner curved rod 14. The adjustable end cap assembly 18 allows the curved curtain rod 10 to be tightly secured between two opposing surfaces, such as the opposing surfaces of walls of a shower or tub enclosure. Alternatively, the fixed end cap assembly 16 may be replaced with an adjustable end cap assembly 18 so that both ends of the curved curtain rod 10 includes adjustable end cap assemblies 18. The low-profile design allows a curtain to be drawn closer to wall for a better seal.

By way of example only, the outer rod 12 may have of length of 43.5 inches, a radius of curvature of 91.419 inches, and an outer diameter of 1.00 inches. The inner rod 14, by way of example only, may have a length of 39.0 inches, a radius of curvature of 91.499 inches, and an outer diameter of 0.840 inches.

A rod adjustment connector 20 is used to secure the rods, 12, 14 at their relative positions to set the desired combined overall length of the rods 12, 14. The rod adjustment connector includes a plate 22 mounted near to an end of the outer rod 12 opposite the fixed end cap assembly 16. The plate 22 defines two screw holes 24 that align with holes through the outer rod 12. Screws thread through the screw holes 24 of the plate 22 and contact an outer surface of the inner rod 14. As an alternative to the rod adjustment connector 20, a rod lock collar 26 may be used. As illustrated in FIGS. 3A-3E, the rod lock collar 26 surrounds the inner rod 14 and can be set at anywhere along the inner rod 14 to establish the combined overall length of the inner and outer rods 12, 14. The collar 26 defines two threaded holes 28 that each receive a screw 29 that contacts an outer surface of the inner rod 14 to lock the collar 26 in place on the inner rod 14. The locked collar 26 then acts as a stop to prevent the inner rod 14 from being further inserted into the outer rod 12.

Figure 4A:
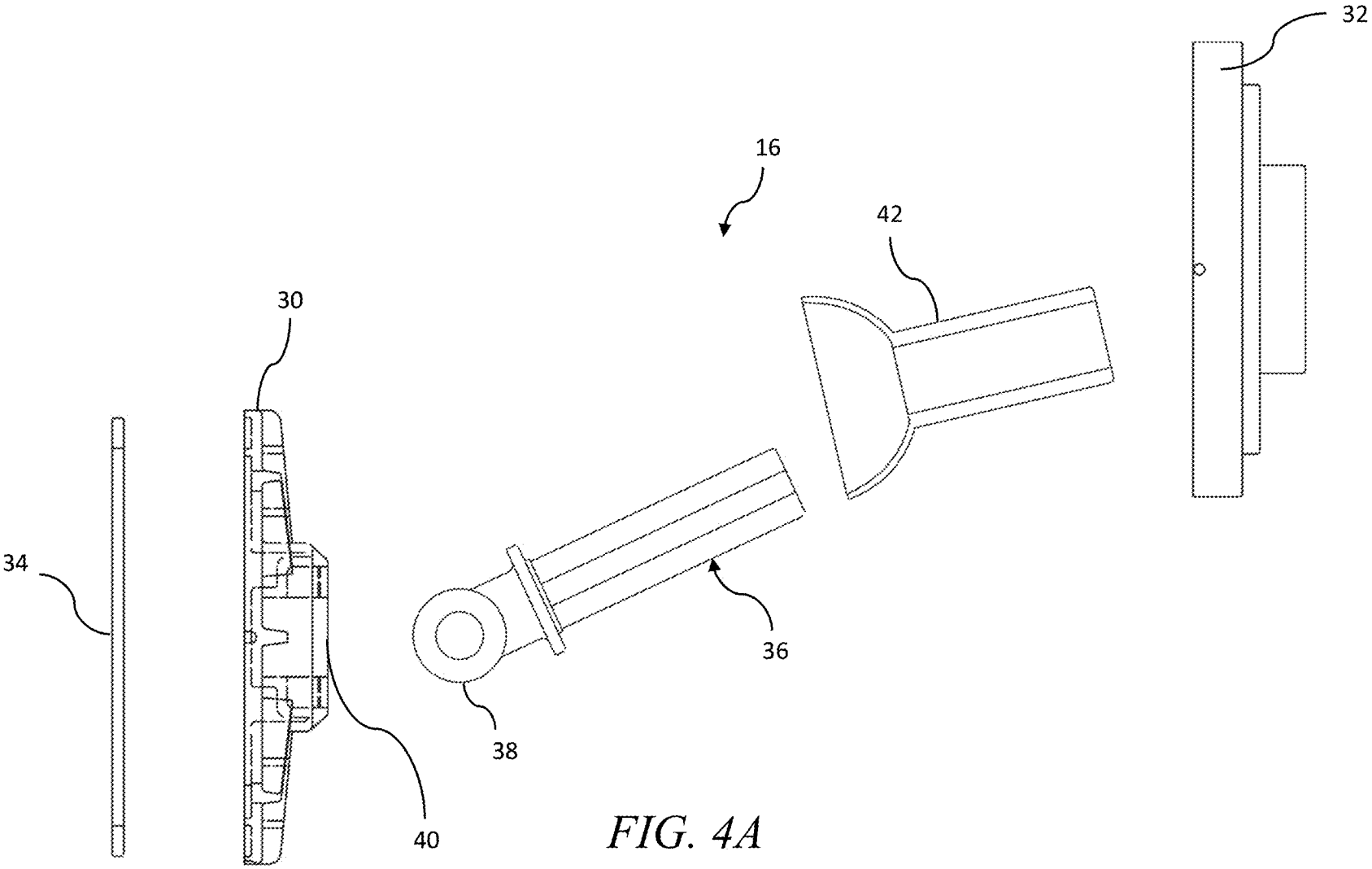
FIG. 4A is an exploded view of a fixed end cap assembly of the curved curtain rod of FIG. 1.
Figure 4B:
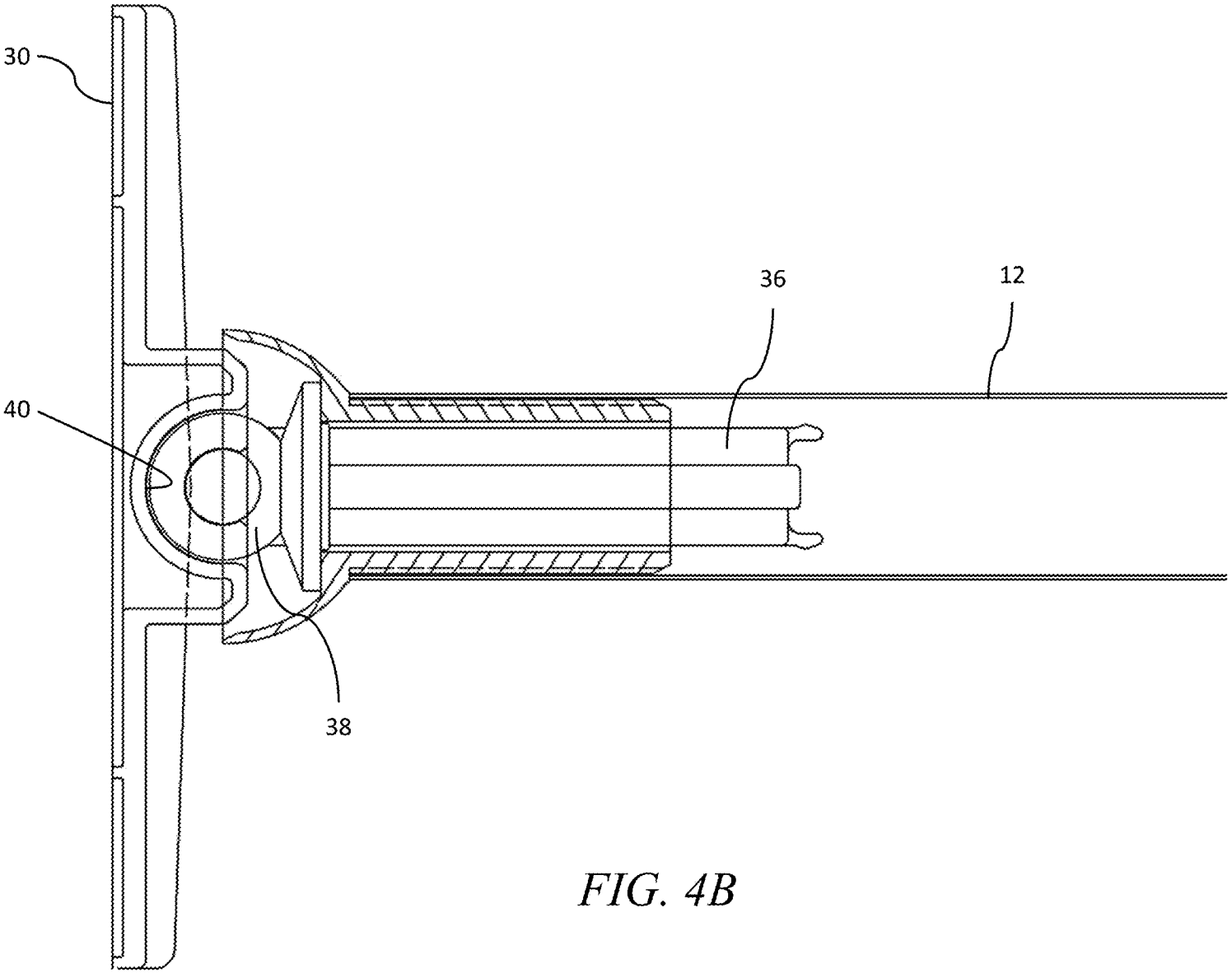
FIG. 4B is a cross-section view of the fixed end cap assembly of FIG. 4A.

With reference to FIGS. 4A and 4B, the fixed end cap assembly 16 includes a wall plate 30 for mounting to a wall and a wall plate cover 32 that fits over the wall plate 30 to provide a pleasing aesthetic appearance. A rubber pad 34 attaches to one side of the wall plate 30 to increase friction with a wall surface for installation and to prevent damage to the wall surface. A shaft 36 inserts into the end of the outer rod 12. An end of the shaft 36 outside the outer rod 12 includes a hub 38 that fits into a complimentary socket 40 defined by the wall plate 32 on a side opposite the rubber pad 34. A bell-shaped cover 42 overlies the interconnection of the hub 38 with the socket 40 of the wall plate 30 to provide a pleasing aesthetic appearance. The bell-shaped cover 42 also extends into the outer rod 12 between the shaft 36 and the outer rod 12. There is a friction fit between the cover 42 and the inner surface of the outer rod 12.

Figure 5A:
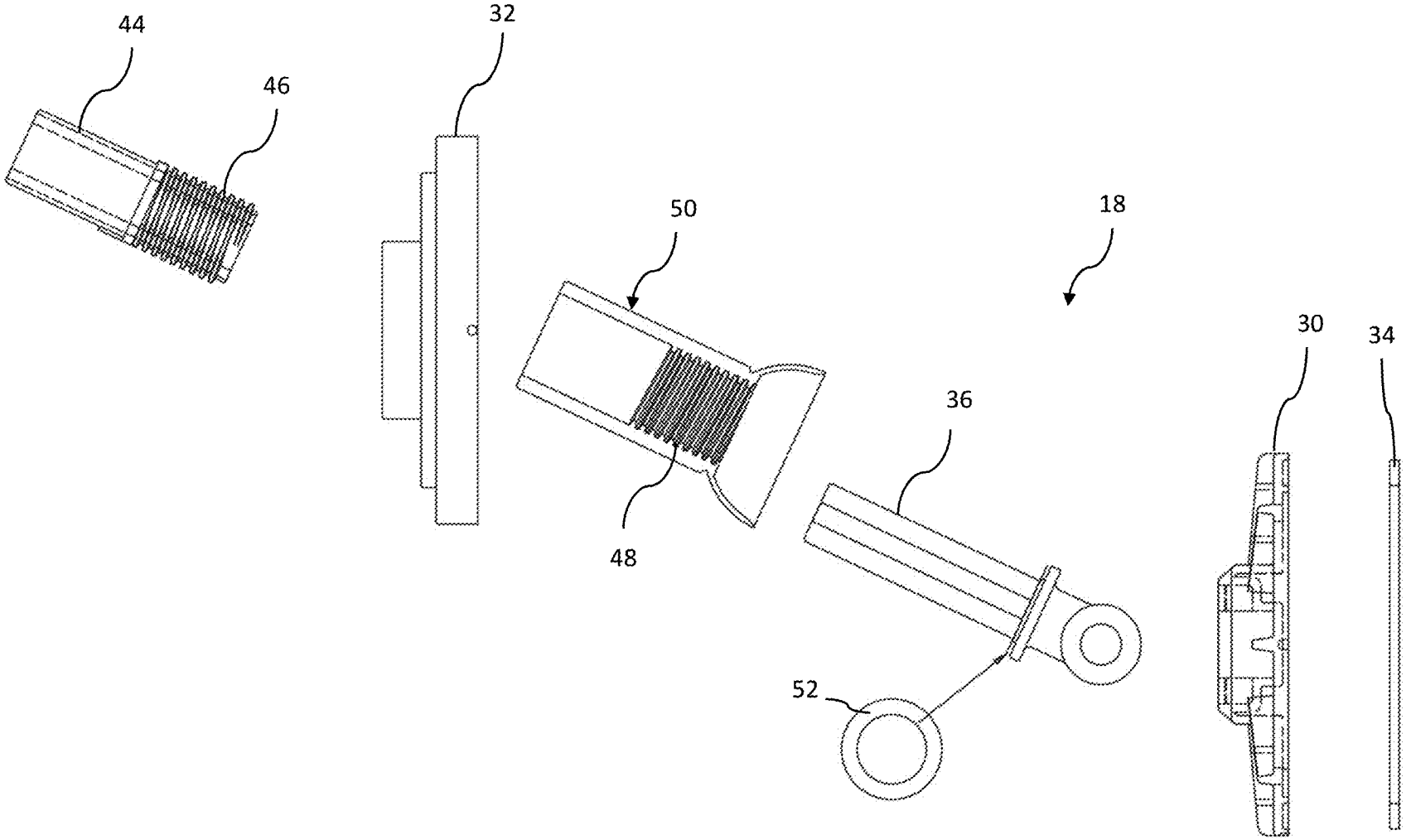
FIG. 5A is an exploded view of an adjustable end cap assembly of the curved curtain rod of FIG. 1.
Figure 5B:
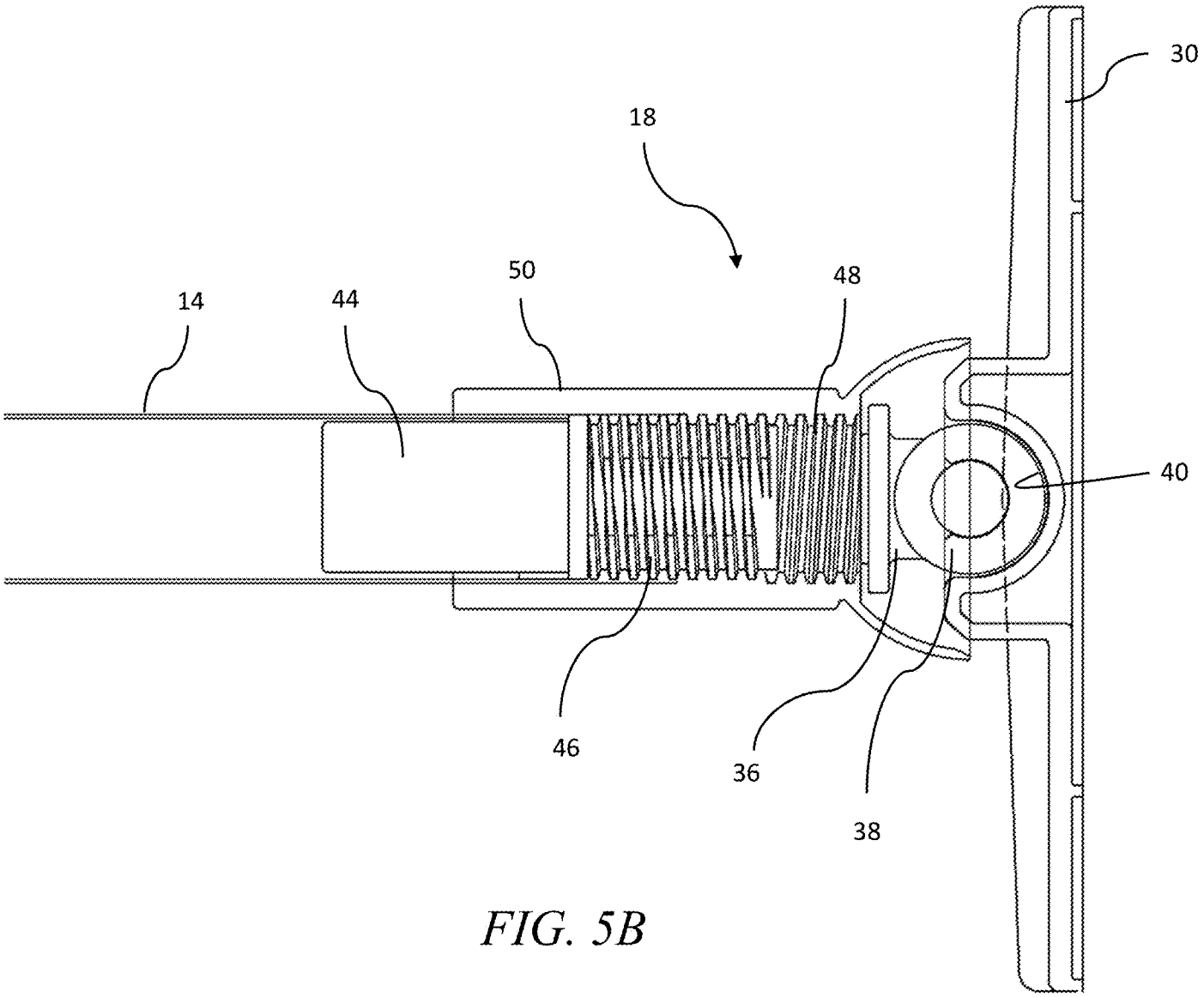
FIG. 5B is a cross-section view of the adjustable end cap assembly of FIG. 5A.
Figure 6A:
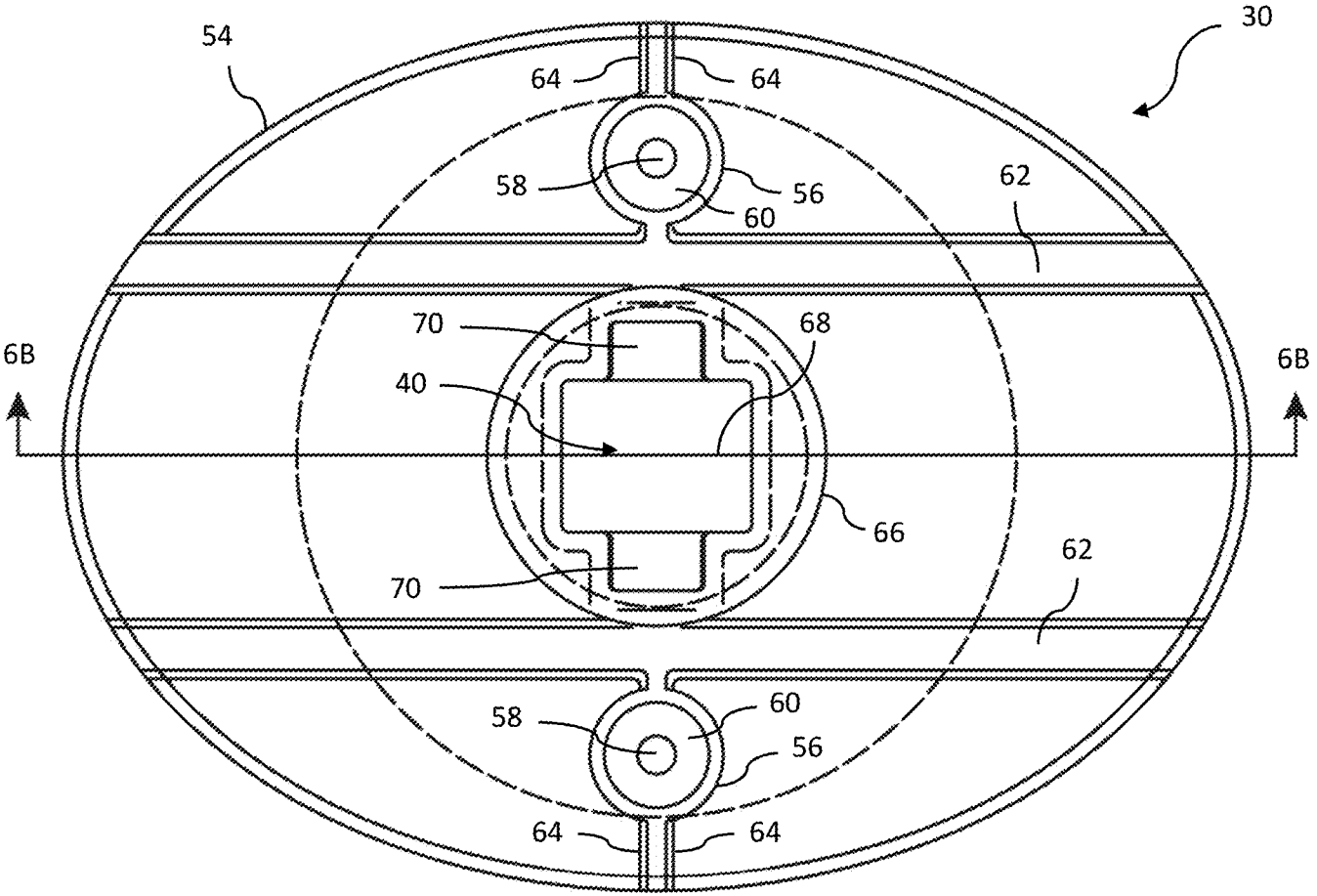
FIG. 6A is a top plan view of a wall plate of the curved curtain rod of FIG. 1.
Figure 6B:
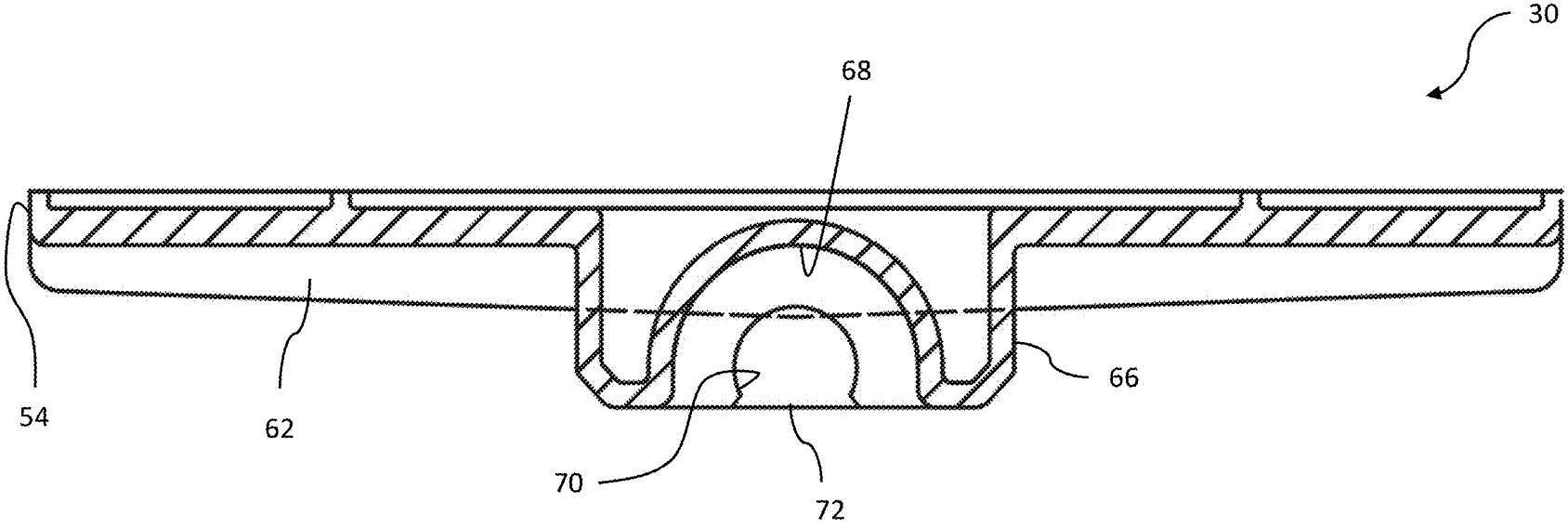
FIG. 6B is a cross-section view of the wall plate of FIG. 6A taken along line 6B-6B of FIG. 6A.
Figure 6C:
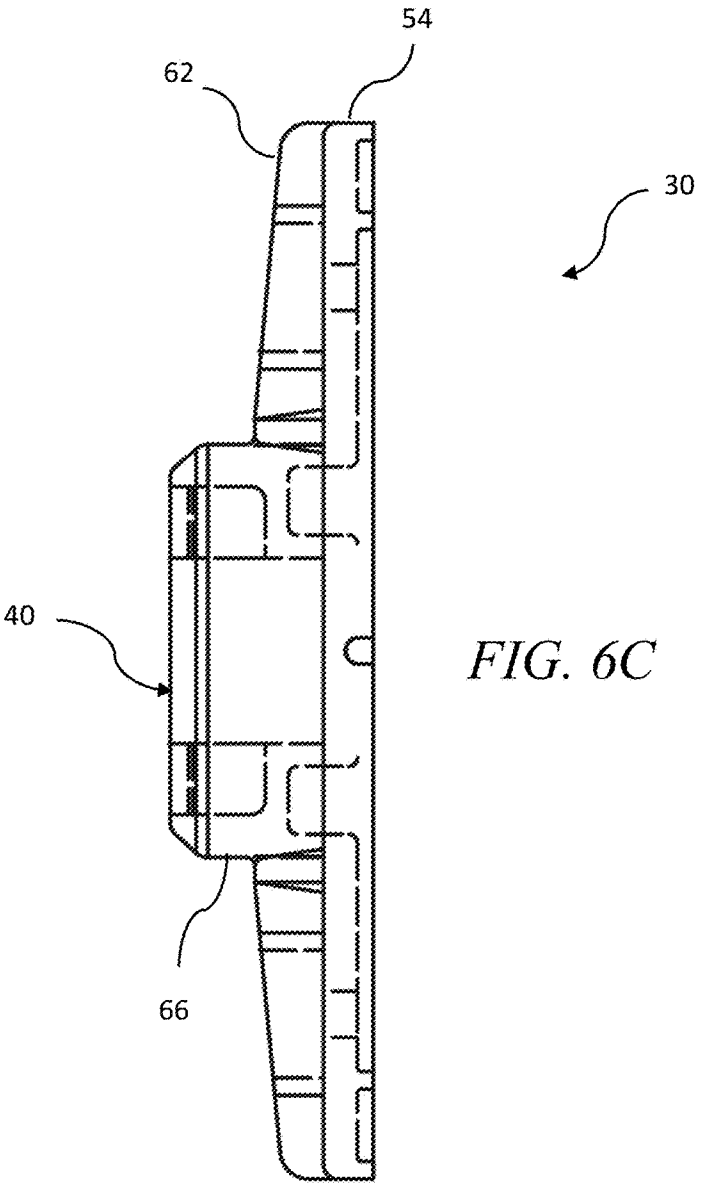
FIG. 6C is a side elevation view of the wall plate of FIG. 6A.
Figure 6D:
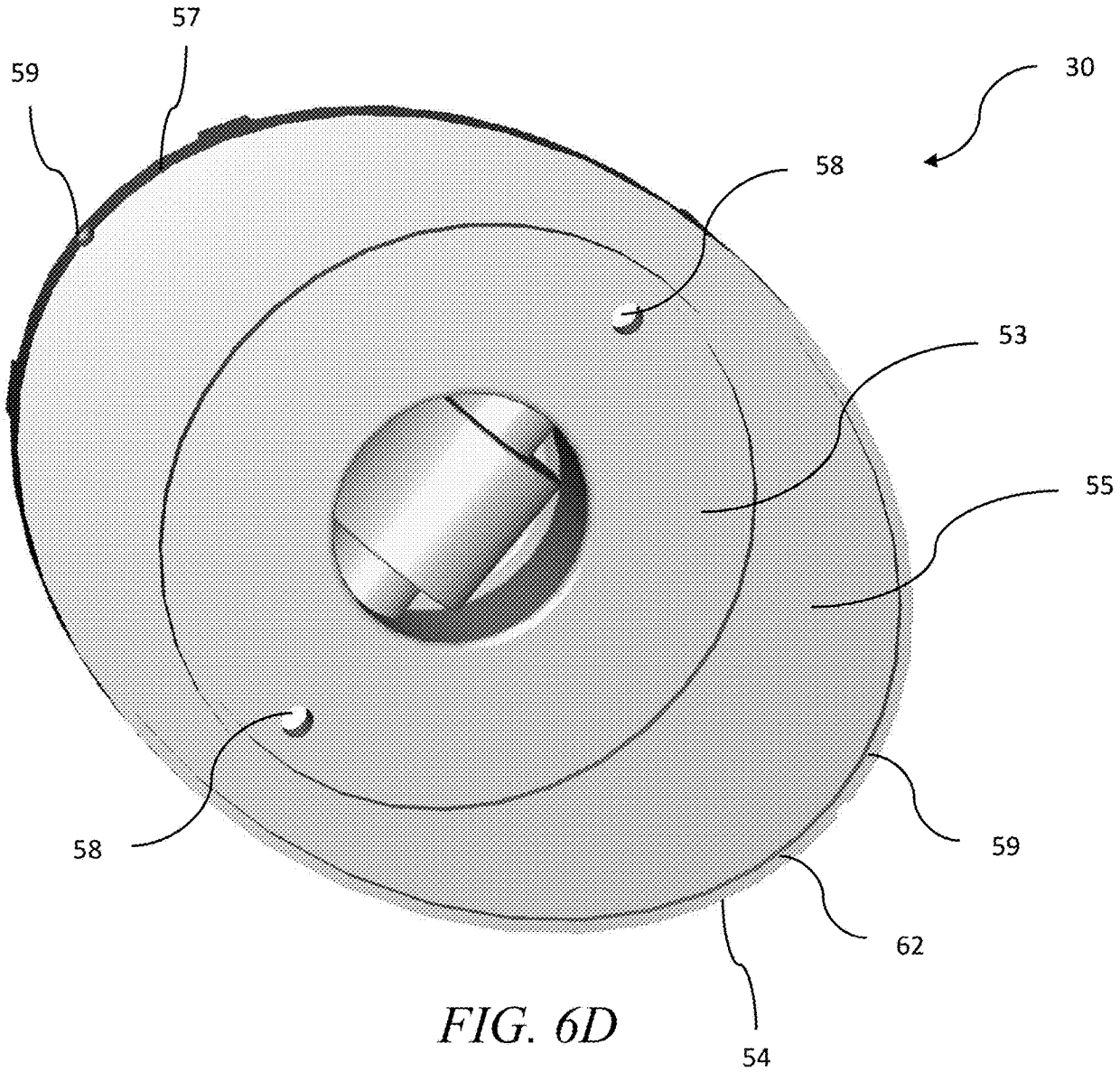
FIG. 6D is a bottom perspective view of the wall plate of FIG. 6A.

Turning to FIGS. 5A and 5B, the adjustable end cap assembly 18 includes components that are identical to those of the fixed end cap assembly 16. For instance, the adjustable cap assembly 18 includes the wall plate 30, the wall plate cover 32, the rubber pad 34 and the shaft 36. The adjustable cap assembly 18 also includes an insert 44 that attaches to the inner rod 14 and includes external threading 46 that cooperates with internal threading 48 of another bell-shaped cover 50 to provide the adjustability of the adjustable end cap assembly 18. The bell-shaped cover 50 overlies the interconnection between the hub 38 of the shaft 36 and the socket 40 of the wall plate 30. The bell-shaped cover 50 also extends over the inner rod 14 with enough clearance to allow the cover 50 to rotate about the inner rod 14. A slip disk 52 is situated between the shaft 30 and the bell-shaped cover 50 to facilitate rotation between the two components. To operate the adjustable end cap assembly 18, a user turns the bell-shaped cover 50 in one direction to lengthen the adjustable end cap assembly 18 to secure the curved curtain rod 10 between two opposing surfaces and turns the bell-shaped cover 50 in an opposite direction to shorten the adjustable end cap assembly 18 to release the curved curtain rod 10 from between two opposing surfaces.

Referring to FIGS. 6A-6D, there is illustrated the wall plate 30. The wall plate 30 has an oval shape formed by a perimeter wall 54. By way of example only, the length may be 5.0 inches, and the width may be 3.65 inches. The wall plate 30 includes bosses 56 that each define a mounting hole 58 and have a countersunk portion 60 to receive heads of mounting screws. The plate 30 includes longitudinally extending wall supports 62 and transversely extending wall supports 64. The wall plate 30 includes a boss 66 centrally located that defines the socket 40. The socket 40 includes a large, arcuate concave center portion 68 and two outer, identical, smaller arcuate concave portions 70. The smaller portions 70 include an opening 72 that has a cross-section dimension slightly smaller than its corresponding portion of the hub 38 on the shaft 36 so that the hub 38 has a snap fit engagement with the socket 40 to secure the hub 38 in the socket 40 against unintentional removal but permits rotation therein.

A bottom side of the wall plate 30 includes a central recess 53 surrounded by an oval surface 55. The central recess 53 is shown as circular but could be oval as well. The perimeter wall 54 extends beyond the oval surface 55 and includes a bottom surface 57. The perimeter wall 54 includes lock recesses 59 for securing the wall plate cover 32 to the wall plate 30.

Figure 7B:
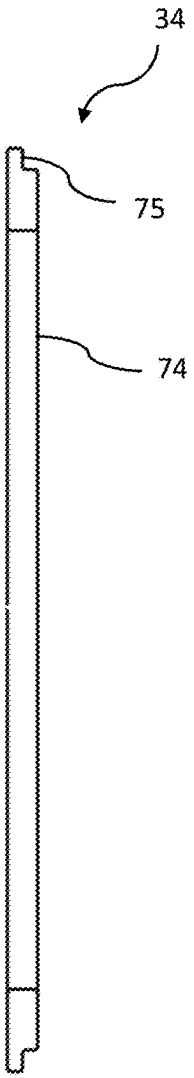
FIG. 7B is a side elevation view of the pad of FIG. 7A.
Figure 7A:
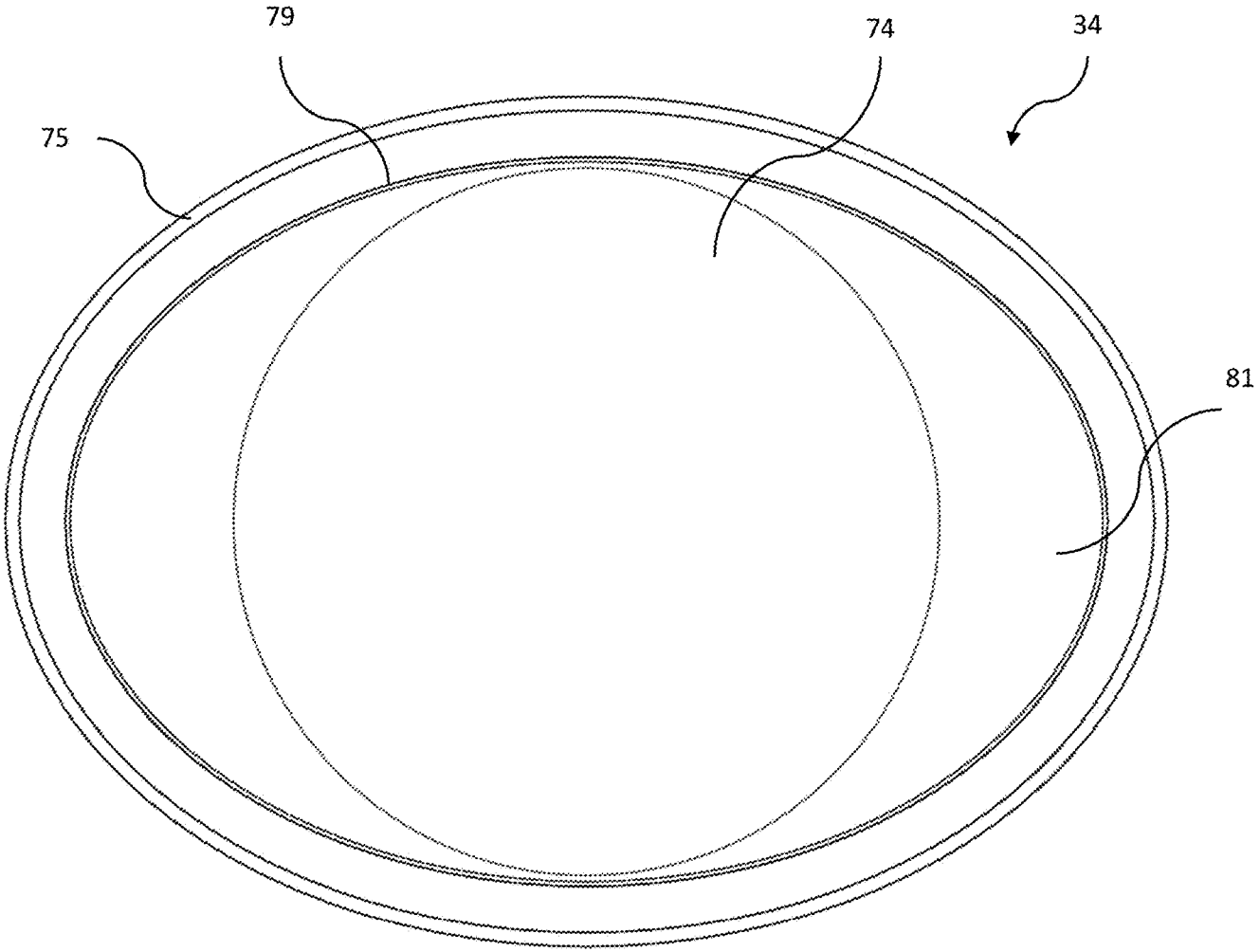
FIG. 7A is a top plan view of a pad of the curved curtain rod of FIG. 1.
Figure 8C:
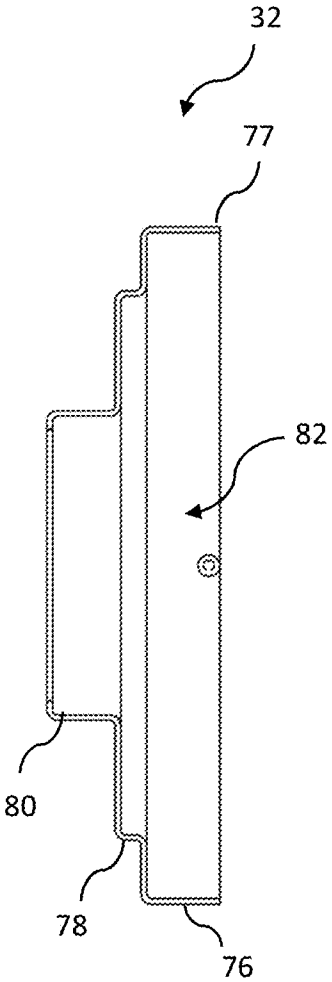
FIG. 8C is a cross-section view of the wall plate of FIG. 8A taken along line 8C-8C of FIG. 8A.
Figure 8A:
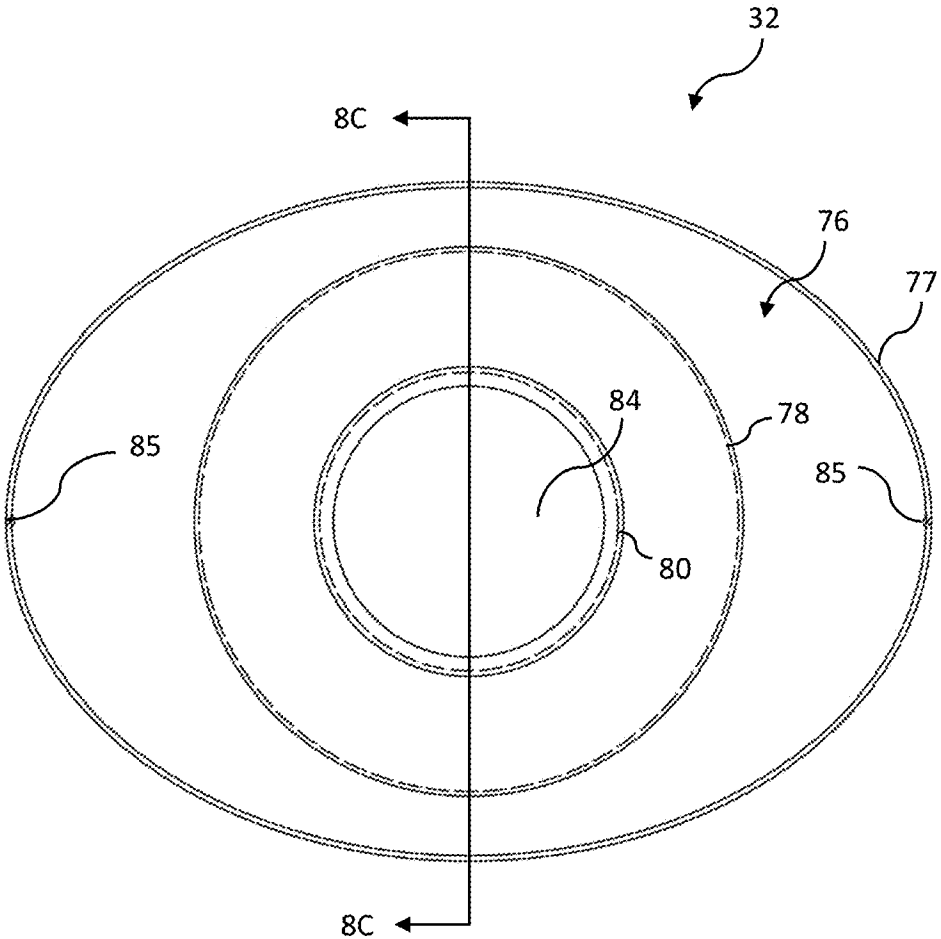
FIG. 8A is a top plan view of a wall plate cover of the curved curtain rod of FIG. 1.
Figure 8B:
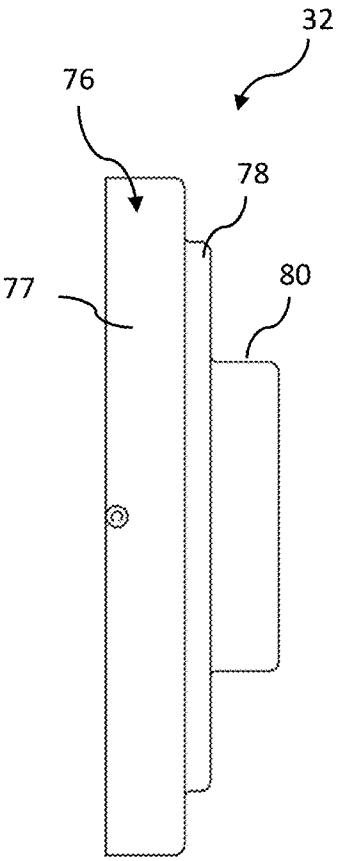
FIG. 8B is a side elevation view of the wall plate of FIG. 8A.
Figure 8D:
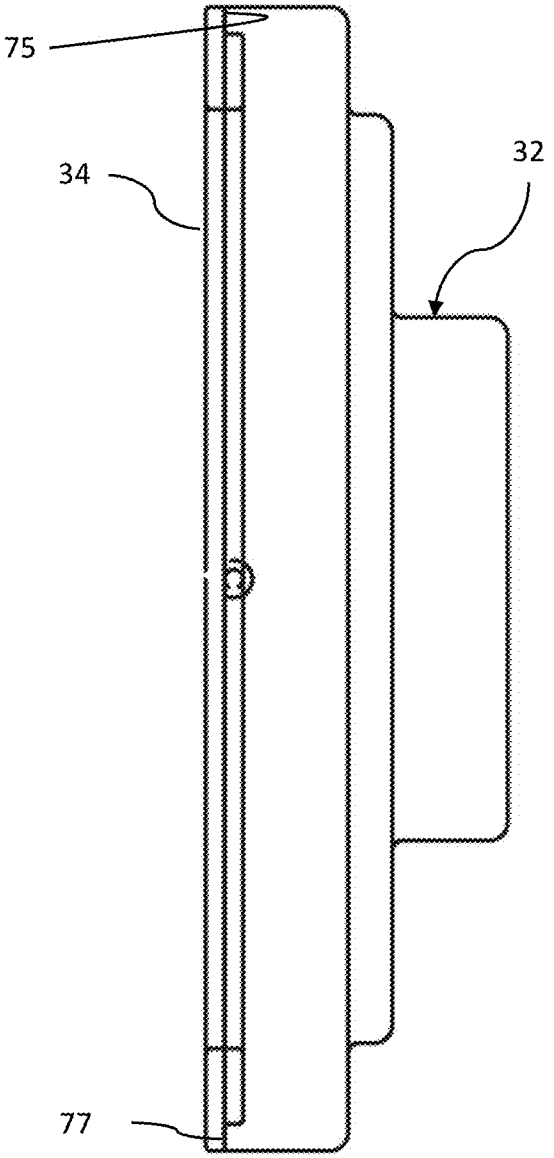
FIG. 8D is a side elevation view of the pad and wall plate cover of the curtain rod of FIG. 1.

With reference to FIGS. 7A and 7B, the rubber pad 34 has an oval shape similar to the wall plate 30. The rubber pad 34 includes hollow center region 74 (i.e., there is no material in this region). The hollow center region 74 can be circular as shown or may be oval. The outer perimeter of the rubber pad 34 includes a step that forms a lower annular surface 75. An edge of the wall cover plate 77 engages the lower annular surface 75 (see FIG. 8D). The bottom surface 57 of the wall plate 30 also may engage the lower annular surface 75.

The rubber pad 34 can be attached to an underside of the wall plate 30 using any conventional method. More specifically, the hollow center region 74 aligns with the central recess 53 of on the bottom side of the wall plate 30. A pressure surface 81 about the hollow center region 74 engages the oval surface 55 of the bottom side of the wall plate 30. The rubber pad 34 may be glued to the wall plate 30. For example, the pressure surface 81 and the oval surface 55 may be glued together.

As noted above, the rubber pad 34 protects wall surfaces. It also prevents rattling and movement when the wall plate 30 is being installed to a wall. It further provides enhanced force against a wall surface to increase the load capacity of the curved curtain rod 10. More specifically, because the pad 34 includes hollow center region 74, the surface area of the pad 34 that engages the wall (the oval area) is decreased. As a result of the decreased surface area of pad 34, the force against the wall is increased. The preferred pressure area on the pad 34 is noted by an oval line 79 centered on the engagement between the pressure surface 81 and oval surface 55. Thus, it is preferred that the pressure provided by the wall plate 30 be concentrated on an area along and about the oval line 79. This preferred placement of the pressure applied by the wall plate 30 also provides increased resistance to downward twisting of the curved shower rod 10 that could be caused by the weight of a curtain hanging from the rods 12, 14.

It has been found that the load capacity can be as much as 2.3 to 6 times the amount of a commercially available curved rod. The table below identifies increased load results.

| | 75% of extension on tile | 88% of extension on tile | 100% of extension on tile |
|---|---|---|---|
| New Design | 28 lbs | 16 lbs | 12 lbs |
| Prior Design | 12 lbs | 5 lbs | 2 lbs |

Regarding FIGS. 8A-8D, the wall plate cover 32 includes three stacked wall sections 76, 78, 80. The first section 76 has an oval shape, and the second and third sections 78, 80 have a circular shape. The three sections 76, 78, 80 are centrally aligned and define a hollow interior 82. The third section 80 defines a circular aperture 84 through which the shaft 36 extends. The first section 76 includes a wall 77 that includes detents 85 projecting inward. The detents 85 can be received in the lock recesses 54 of the wall plate 30 to secure the wall plate cover 32 to the wall plate 30.

Figure 9A:
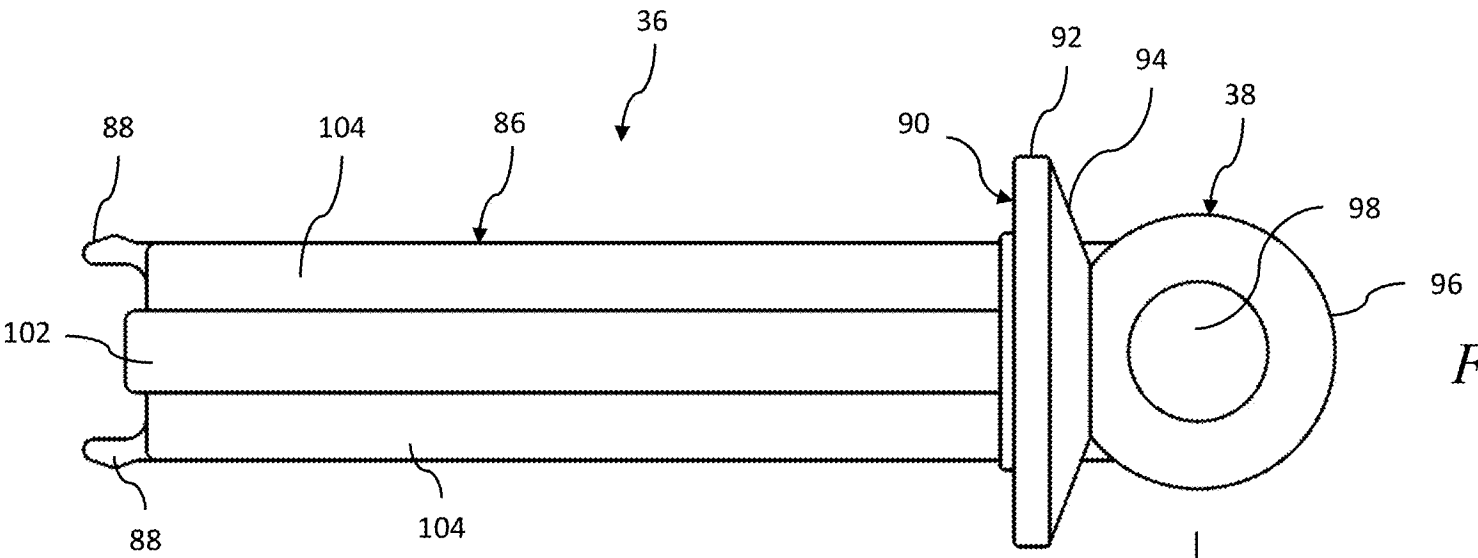
FIG. 9A is a side elevation view of a shaft of the curved rod of FIG. 1.
Figure 9B:
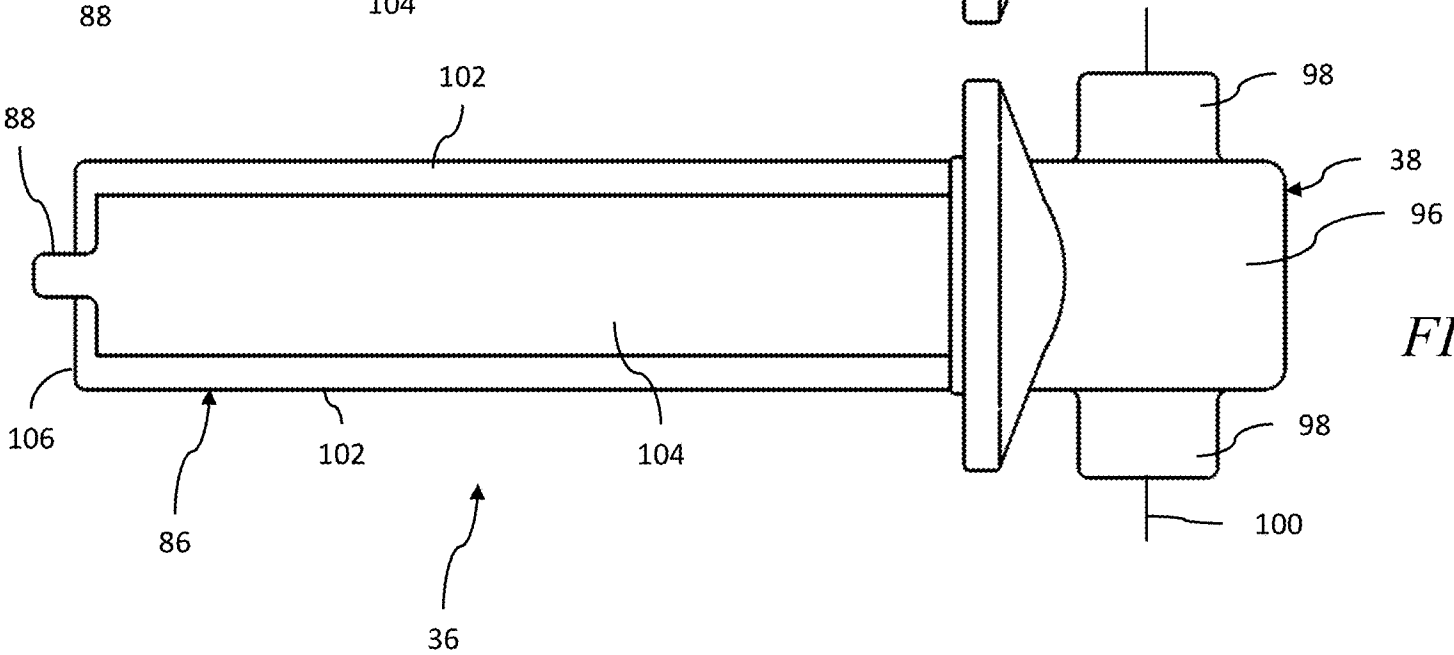
FIG. 9B is a side elevation view of the shaft of FIG. 9A.
Figure 9C:
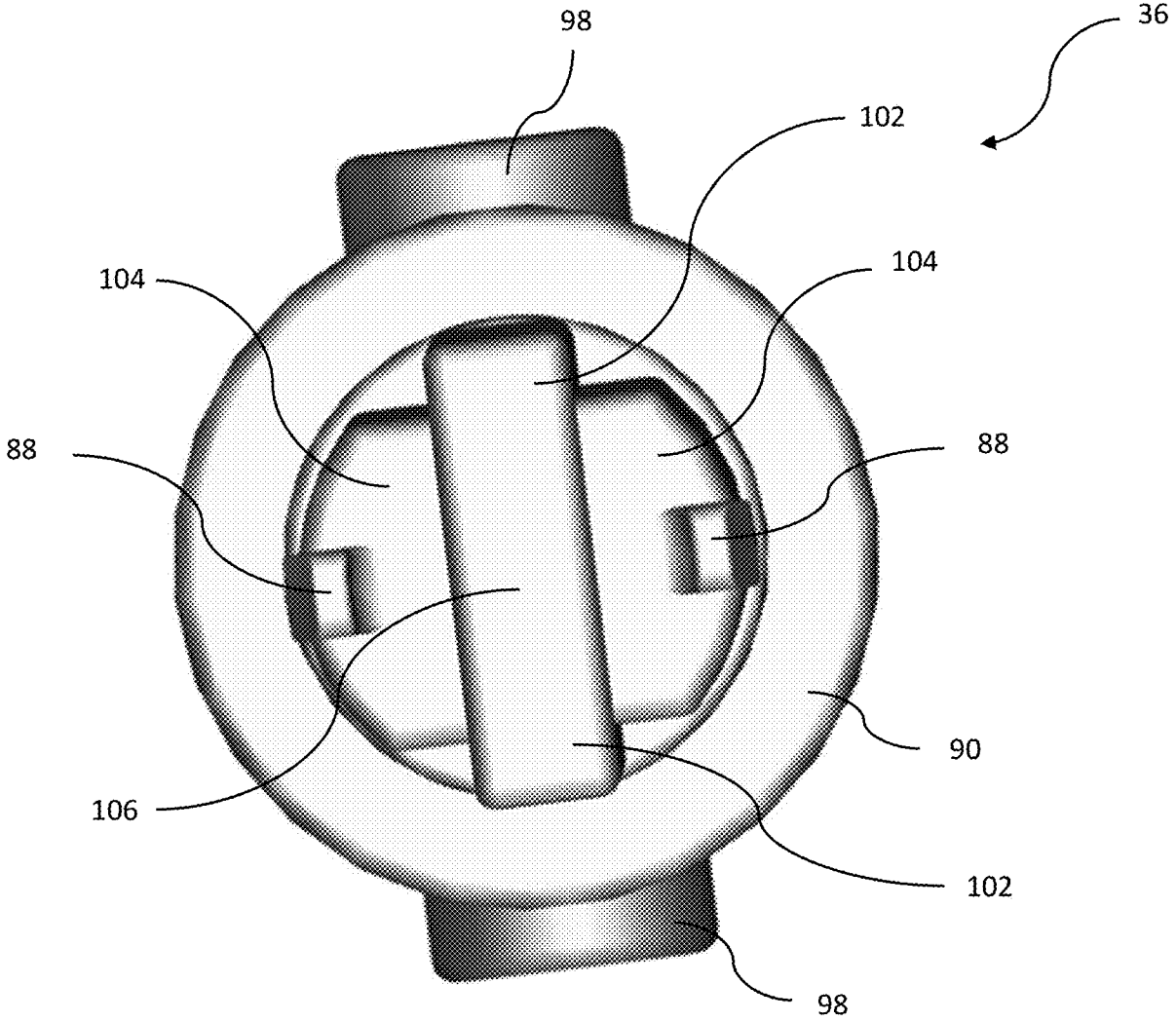
FIG. 9C is top plan view of the shaft of FIG. 9A.
Figure 10D:
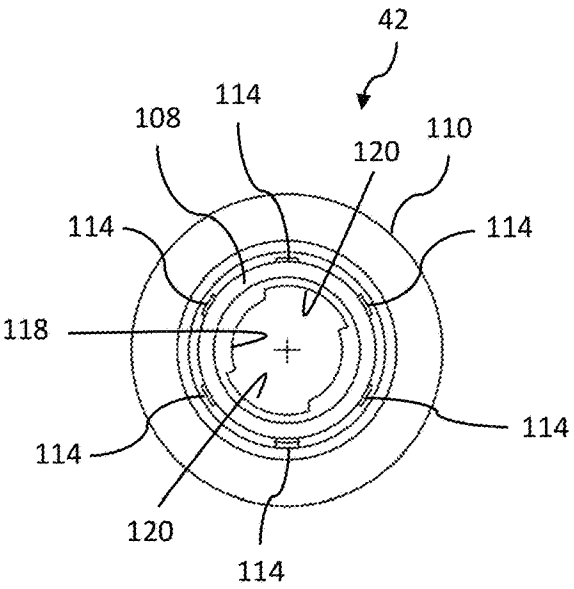
FIG. 10D is a top plan view of the bell-shaped cover of FIG. 10A.
Figure 10B:
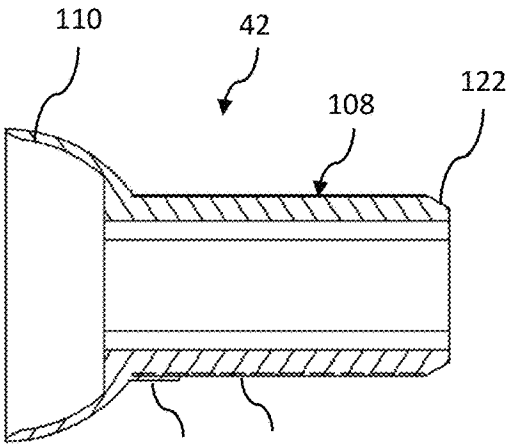
FIG. 10B is a cross-section view of the bell-shaped cover of FIG. 10A taken along line 10B-10B of FIG. 10A.
Figure 10A:
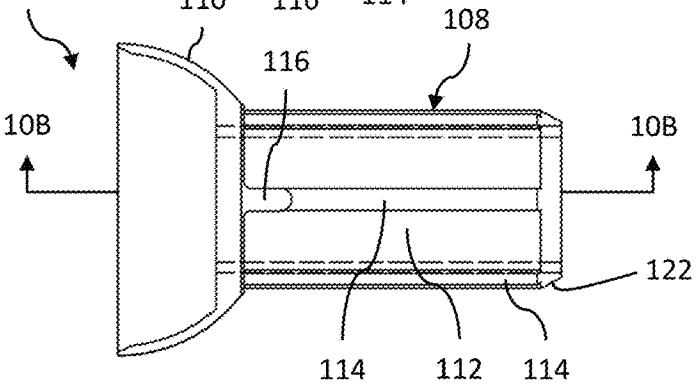
FIG. 10A is a side elevation view of a bell-shaped cover of the fixed end cap assembly of FIG. 4A.
Figure 10C:
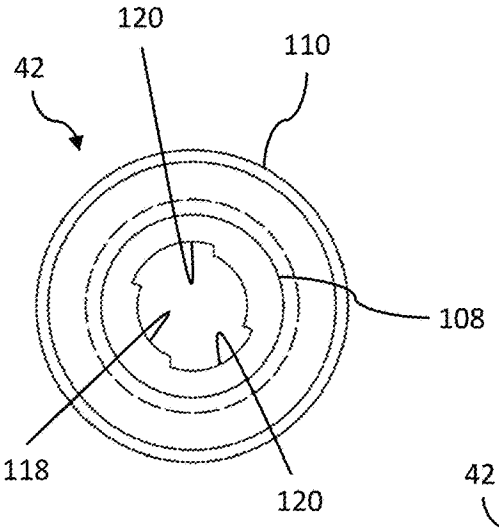
FIG. 10C is a bottom plan view of the bell-shaped cover of FIG. 10A.

In FIGS. 9A-9C, there is illustrated the shaft 36 used in both the fixed end cap assembly 16 and the adjustable end cap assembly 18. The shaft 36 includes an elongated segment 86 with a generally plus-sign cross-section formed by rectangular ribs 102 and arcuate ribs 104. The rectangular ribs 102 can extend across a terminal end 106 of the elongated segment 86. The terminal end 106 of the elongated segment 86 includes two diametrically opposed fingers 88 that extend longitudinally away from the elongated shaft 36. The other end of the elongated segment 86 includes an annular flange 90 and the hub 38. The annular flange 90 resides between the elongated segment 86 and the hub 38 and includes a straight portion 92 and a conical portion 94.

The hub 38 includes a central cylindrical portion 96 and two smaller cylindrical portions 98 extending outward from the hub 38 along a rotational axis 100 of the hub 38.

The central cylindrical portion 96 is received in the large concave center portion 68 of the socket 40 of the wall plate 30. The two smaller cylindrical portions 98 are each received with a snap fit in the small concave outer portions 70 of the socket 40 of the wall plate 30. This enables the shaft 36 to pivot in the socket 40 about the rotational axis 100 of the hub 38.

Turning to FIGS. 10A-10D, there is illustrated the bell-shaped cover 42 for the fixed end cap assembly 16. The cover 42 includes an elongated cylindrical portion 108 and a domed portion 110. An exterior 112 of the cylindrical portion 108 includes longitudinal ribs 114 that help provide a friction fit in the end of the outer rod 12. One of the ribs 114 also includes a short rib 116 piggybacked on top. This short rib 116 is sized to fit into a notch in the end of the outer rod 12 so that the cover does not rotate relative to the rod 12. An inside surface 118 of the cylindrical portion 108 includes two diametrically opposing elongated channels 120 that receive the ribs 102 of the shaft 36. The ribs 102 have a slight clearance in the channels 120 so that the cover 42 may rotate relative to the shaft 36 (e.g., a few degrees). A terminal end 122 of the cylindrical portion 108 may include an annular chamfer to aid in inserting the cover 42 into to the outer rod 12.

Figure 11C:
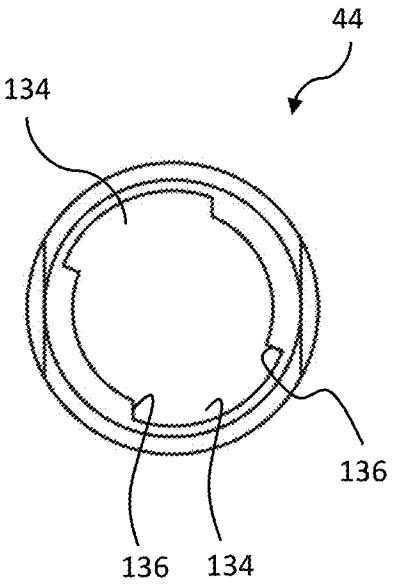
FIG. 11C is a top plan view of the insert of FIG. 11B.
Figure 11B:
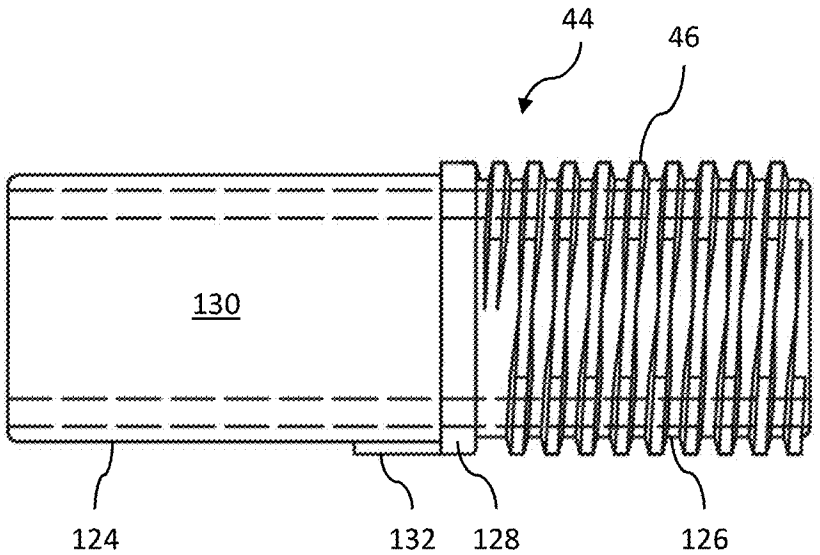
FIG. 11B is a side elevation view of the insert of FIG. 11A.
Figure 11A:
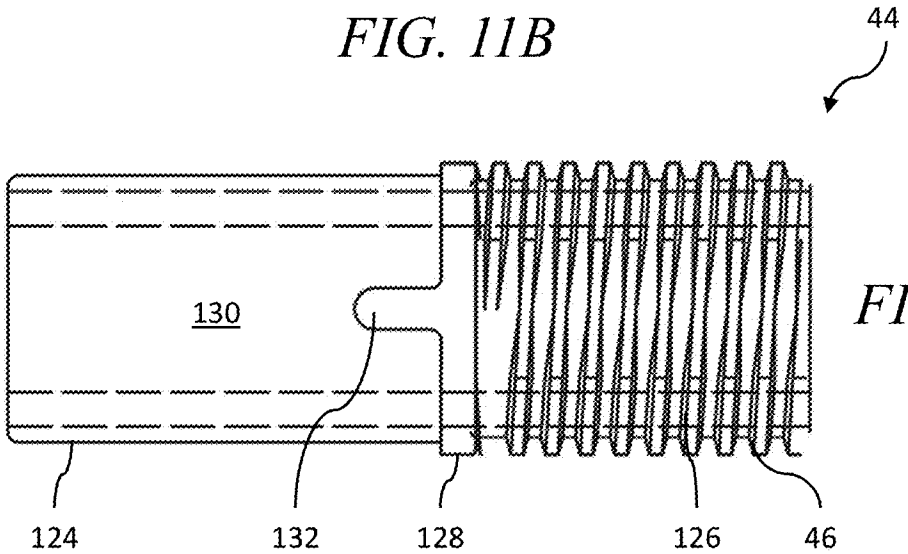
FIG. 11A is a side elevation view of an insert of the adjustable end cap assembly of FIG. 5A.

Referring to FIGS. 11A-11C, there is illustrated the insert 44 for the adjustable end cap assembly 18. The insert 44 is hollow therethrough and includes a cylindrical portion 124 and a threaded portion 126. The threaded portion 126 includes the threading 46, which is right-handed threading. The cylindrical portion 124 and the threaded portion 126 are separated by an annular flange 128. The cylindrical portion 124 includes a smooth outer surface 130 that inserts into the inner rod 14 with a friction fit so that it cannot be unintentionally removed. By way of example only, the outer diameter of the cylindrical portion 124 of the insert 44 may be 0.768 inches, and the inner diameter of the inner rod 14 may be 0.875 inches. The annular flange 128 acts as a stop to limit how far the insert 44 may be inserted into the inner rod 14. Annular flange 128 prevents the insert 44 from being inserted beyond the cylindrical portion 124 so that the threads 46 do not become damaged. The cylindrical portion 124 includes a small longitudinally extending rib 132 adjacent the annular flange 128 that is received in a slot formed in a terminal end of the inner rod 14 to prohibit the insert 44 from rotating relative to the inner rod 14.

The threaded portion 126 defines diametrically opposed and longitudinally extended arcuate channels 134. Each of the channels 134 includes opposing stops 136. The rectangular ribs 102 of the shaft 36 are received in the channels 134 between the stops 136 when the shaft 36 extends into insert 44. The stops 136 are spaced so that the ribs 102 can rotate up to 45 degrees in the channels 134. This allows rotational play between the shaft 36 and insert 44.

Figure 12B:
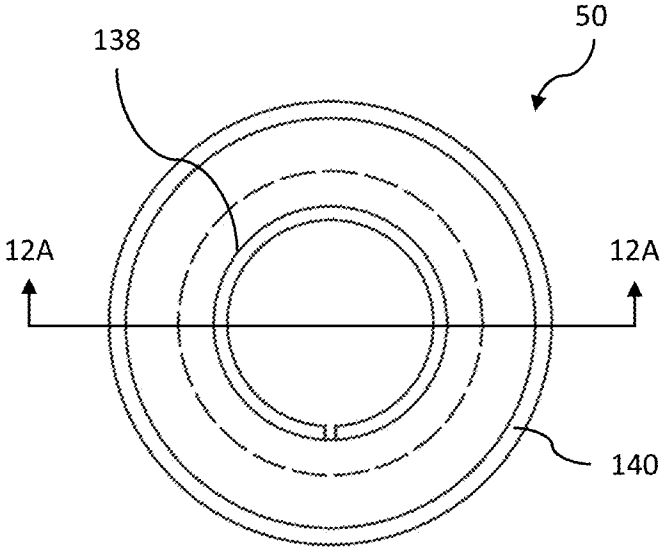
FIG. 12B is bottom plan view of the bell-shaped cover of FIG. 12A.
Figure 12A:
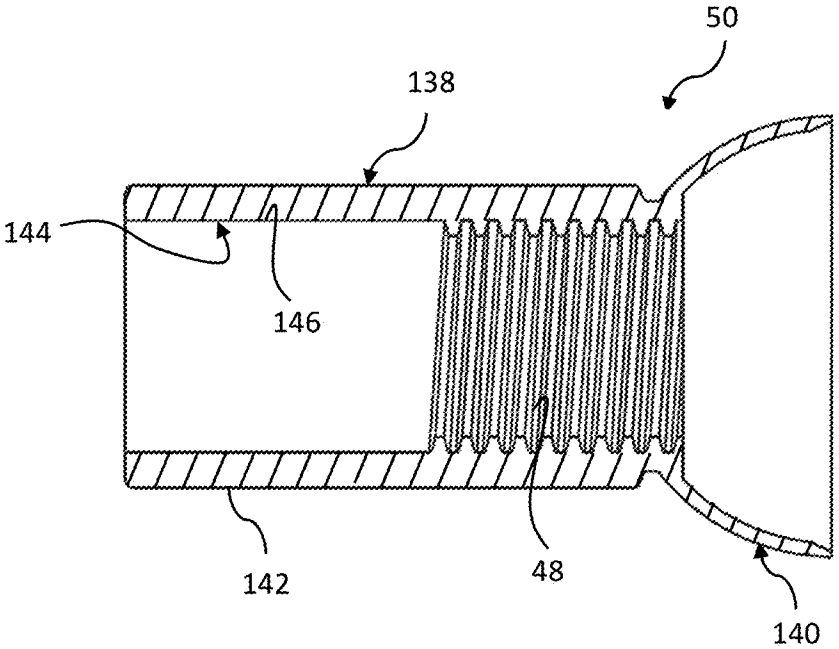
FIG. 12A is cross-section view of a bell-shaped cover of the adjustable end cap assembly of FIG. 5A taken along line 12A-12A of FIG. 12B.

With reference to FIGS. 12A and 12B, there is illustrated the bell-shaped cover 50 for the adjustable end cap assembly 18. The bell-shaped cover 50 is hollow and includes an elongated cylindrical portion 138 and a domed portion 140. The cylindrical portion 138 includes an outer surface 142 for gripping to operate the adjustable end cap assembly 18 and an inner surface 144 with a smooth portion 146 and a threaded portion with the threading 48. The insert 44 extends into the cylindrical portion with its threading 46 mating with the threading 48 of the cover 50. The domed portion 140 covers the interconnection between the hub 38 of the shaft 36 and the socket 40 of the wall plate 30.

To install the curved curtain rod 10, a user determines the desired location on opposing wall surfaces to mount the wall plates 30. The wall plates 30 should be positioned directly opposite one another both horizontally and vertically on the wall surfaces. The wall plates 30 are then mounted with fasteners, such as nails or screws, extending through the mounting holes 58. Screw anchors also may be used.

Next, the outer rod 12 and the inner rod 14 are extended relative to one another so that the fixed end cap assembly 16 and the adjustable end cap assembly 18 can be mounted in their wall plate 30. To do this, the hub 38 of the shaft 36 is snapped into the socket 40 of the wall plate 30. The wall plate covers 32 are then snapped onto the wall plates 30. The bell-shaped covers 42, 50 are then put in place over the interconnection between shaft 36 and the socket 40.

In the next step, the outer rod 12 and the inner rod 14 can be secured together using the rod adjustment connector 20 or the lock collar 26. Finally, the adjustable end cap assembly 18 is used to tighten the curved curtain rod 10 between the wall plates 30 mounted to the wall surfaces. The bell-shaped cover 50 of the adjustable end cap assembly 18 is turned away from the user to extend the adjustable end cap assembly 18 to put pressure on the wall plates 30 and the wall surfaces.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the technological contribution. The actual scope of the protection sought is intended to be defined in the following claims.

What is claimed is:

1. An adjustable curved curtain rod assembly comprising:
a first curved rod; and
an adjustable end cap assembly comprising:
a first wall plate;
a first shaft having a first pivot connection to the first wall plate;
an insert being mounted to the first curved rod and slidably receiving at least a portion of the first shaft and having external threading; and
a handle having internal threading that mates with the external threading of the insert;
wherein rotation of the handle in one direction moves the internal threading of the handle along the external threading of the insert causing the handle to exert force on the first shaft in a first direction and the insert to exert force on the first curved rod in a second direction.

2. The adjustable curved curtain rod assembly of claim 1 wherein the insert engages an inside surface of the first curved rod.

3. The adjustable curved rod assembly of claim 1 wherein the insert includes a rib that interconnects with the first curved rod to prohibit rotation of the insert relative to the first curved rod.

4. The adjustable curved rod assembly of claim 1 wherein the insert includes a pair of spaced internal stops enabling the insert to rotate relative to the first shaft a predetermined amount of rotation therebetween.

5. The adjustable curved rod assembly of claim 1 wherein the handle covers at least a portion of the first pivot connection.

6. The adjustable curved rod assembly of claim 1 further comprising a second rod.

7. The adjustable curved rod assembly of claim 6 further comprising a fixed end cap assembly, the fixed end cap assembly comprising a second wall plate, a second shaft with a second pivot connection to the second wall plate, and a cover having a first portion extending inside the second rod and a second portion covering the second pivot connection.

8. An adjustable curved curtain rod assembly comprising:

a curved rod;

an end cap assembly comprising:

a wall plate having a first side to press against a wall and a second side opposite the first side defining a socket with an arcuate bottom, the socket being fixed relative to the wall plate;

a shaft extending to the curved rod and having a longitudinal axis and a cylindrical end extending transverse to the longitudinal axis;

wherein the cylindrical end being received in the socket with a snap fit to allow rotation of the shaft relative to the wall plate.

9. The adjustable curved rod assembly of claim 8 wherein the socket includes a large socket contiguous with a small socket.

10. The adjustable curved rod assembly of claim 9 wherein the cylindrical end includes a large portion and a small portion, the large portion being received in the large socket and the small portion being received in the small socket.

11. The adjustable curved rod assembly of claim 10 wherein the small portion of the cylindrical end has a snap fit with the small socket to retain the shaft attached to the wall plate.

12. A curved curtain rod assembly comprising:

a curved rod;

an end cap assembly having a wall plate and an elastic pad being associated with the wall plate; and the elastic pad extending along a periphery of the wall plate and having a central opening;

the elastic pad having a first maximum area of coverage and the wall plate having a second maximum area of coverage, the first maximum area of coverage being less than the second maximum area of coverage.

* * * * *